US008713805B2

(12) United States Patent
Schneider et al.

(10) Patent No.: US 8,713,805 B2
(45) Date of Patent: May 6, 2014

(54) HAND CUTTING TOOL

(75) Inventors: Daniel H. Schneider, Franklin, WI (US); Scott R. Fischer, Menomonee Falls, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 356 days.

(21) Appl. No.: 13/191,943

(22) Filed: Jul. 27, 2011

(65) Prior Publication Data

US 2012/0023756 A1 Feb. 2, 2012

Related U.S. Application Data

(60) Provisional application No. 61/368,146, filed on Jul. 27, 2010.

(51) Int. Cl.
*B26B 13/00* (2006.01)

(52) U.S. Cl.
USPC ..... 30/262; 30/244

(58) Field of Classification Search
USPC ..... 30/120.1–120.5, 173, 194, 261, 262
See application file for complete search history.

(56) References Cited

U.S. PATENT DOCUMENTS

| | | | | |
|---|---|---|---|---|
| 540,464 | A | | 6/1895 | Stockmann |
| 776,879 | A | | 12/1904 | Wolfe |
| 1,388,398 | A | | 8/1921 | Adams |
| 2,264,840 | A | | 12/1941 | Isaac |
| 2,544,197 | A | | 3/1951 | Vosbikian et al. |
| 2,579,272 | A | | 12/1951 | Ralston |
| 2,594,363 | A | | 4/1952 | Stephenson |
| 2,668,464 | A | | 2/1954 | Paules |
| 2,674,796 | A | | 4/1954 | Herold |
| 2,742,698 | A | | 4/1956 | McGary et al. |
| 2,990,735 | A | | 7/1961 | Manning |
| 3,044,081 | A | | 7/1962 | Robinson, Jr. |
| 3,092,152 | A | | 6/1963 | Neff |
| 3,339,281 | A | | 9/1967 | Chow |
| 3,357,287 | A | * | 12/1967 | Wertepny ..... 81/322 |
| 3,416,226 | A | | 12/1968 | Pfaffenback |
| 3,596,355 | A | | 8/1971 | Wertepny, Sr. |
| 3,831,207 | A | | 8/1974 | Boyajian |
| 3,839,794 | A | | 10/1974 | Deale |
| 3,947,905 | A | | 4/1976 | Neff |

(Continued)

FOREIGN PATENT DOCUMENTS

| | | |
|---|---|---|
| EP | 598467 | 5/1994 |
| JP | 6055331 | 3/1994 |
| JP | 10235032 | 9/1998 |

*Primary Examiner* — Sean Michalski
(74) *Attorney, Agent, or Firm* — Michael Best & Friedrich LLP

(57) ABSTRACT

A hand cutting tool includes a handle lock assembly configured to retain handles of the cutting tool in a closed position. The handle lock assembly includes a latch that pivots with respect to a first handle about a latch axis from a locked position to an unlocked position and a pin manually movable with respect to a second handle between an engaged position and a released position. In a latched position of the handle lock assembly, the latch is in the locked position and engages the pin in the engaged position to retain the second handle in the closed position, and in an unlatched position of the handle lock assembly, the latch is in the unlocked position and is disengaged from the pin in response to the pin being manually moved to the released position to allow the second handle to move toward the open position.

20 Claims, 3 Drawing Sheets

(56) References Cited

U.S. PATENT DOCUMENTS

| | | | | | |
|---|---|---|---|---|---|
| 3,971,131 | A | | 7/1976 | Boyajian et al. | |
| 4,104,752 | A | | 8/1978 | Amrein et al. | |
| 4,150,484 | A | | 4/1979 | Hildebrandt | |
| 4,258,472 | A | | 3/1981 | Wallace et al. | |
| 4,268,963 | A | | 5/1981 | Harrison | |
| 4,337,542 | A | | 7/1982 | Theiler, Sr. | |
| 4,462,157 | A | | 7/1984 | Aiken | |
| 4,463,497 | A | | 8/1984 | O'Keeffe | |
| 4,502,222 | A | | 3/1985 | Sargent | |
| 4,569,132 | A | * | 2/1986 | Hill | 30/251 |
| 4,947,553 | A | * | 8/1990 | Bendickson et al. | 30/262 |
| 4,967,475 | A | | 11/1990 | O'Keeffe et al. | |
| 5,003,695 | A | | 4/1991 | Lipscomb et al. | |
| 5,074,046 | A | | 12/1991 | Kolesky | |
| D327,826 | S | | 7/1992 | Neff | |
| 5,179,783 | A | | 1/1993 | Melter | |
| 5,220,856 | A | | 6/1993 | Eggert et al. | |
| 5,263,254 | A | | 11/1993 | Orthey | |
| 5,297,343 | A | | 3/1994 | Melter et al. | |
| 5,323,502 | A | | 6/1994 | Miller | |
| 5,347,670 | A | | 9/1994 | Duguette et al. | |
| 5,377,412 | A | | 1/1995 | Schofield et al. | |
| 5,408,904 | A | * | 4/1995 | Neff | 81/360 |
| 5,426,857 | A | * | 6/1995 | Linden | 30/262 |
| 5,628,115 | A | | 5/1997 | Hebert | |
| 5,636,443 | A | | 6/1997 | Linden | |
| 5,699,617 | A | | 12/1997 | Mock | |
| 5,787,589 | A | | 8/1998 | Auderset | |
| 5,987,755 | A | | 11/1999 | Shih | |
| 6,029,297 | A | | 2/2000 | French | |
| D421,376 | S | | 3/2000 | Neff | |
| 6,189,219 | B1 | | 2/2001 | Mock | |
| 6,270,134 | B1 | | 8/2001 | Lin | |
| 6,301,787 | B2 | | 10/2001 | Mock | |
| 6,336,272 | B1 | * | 1/2002 | Lee | 30/262 |
| 6,408,523 | B1 | | 6/2002 | Schmidt | |
| 6,408,725 | B1 | * | 6/2002 | Janson | 81/407 |
| 6,418,626 | B1 | | 7/2002 | Jang | |
| 6,446,344 | B1 | | 9/2002 | Gontar | |
| 6,574,870 | B1 | * | 6/2003 | Huang | 30/252 |
| 6,588,039 | B1 | * | 7/2003 | Bates | 7/107 |
| 6,618,885 | B1 | | 9/2003 | Blaustein | |
| 6,619,158 | B2 | | 9/2003 | Bates et al. | |
| D485,146 | S | | 1/2004 | Rivera | |
| 6,687,991 | B2 | | 2/2004 | Murg | |
| 6,691,403 | B1 | | 2/2004 | Murg | |
| 6,739,217 | B2 | | 5/2004 | Hartranft et al. | |
| 6,752,054 | B2 | | 6/2004 | Knight | |
| D494,032 | S | | 8/2004 | Rivera | |
| 6,772,520 | B1 | | 8/2004 | Shih | |
| 6,813,835 | B2 | | 11/2004 | Deville | |
| D500,236 | S | | 12/2004 | Albert et al. | |
| D503,081 | S | | 3/2005 | Lucus et al. | |
| 6,860,018 | B2 | * | 3/2005 | Schneider et al. | 30/262 |
| 6,941,663 | B2 | | 9/2005 | Still | |
| 7,080,455 | B1 | | 7/2006 | Ronan et al. | |
| 7,089,619 | B2 | | 8/2006 | Smith | |
| 7,100,481 | B2 | | 9/2006 | Hartranft | |
| 7,143,672 | B1 | | 12/2006 | Di Bitonto | |
| 7,171,712 | B2 | | 2/2007 | Konen | |
| 7,346,991 | B1 | | 3/2008 | Janson | |
| 7,353,736 | B2 | | 4/2008 | Poehlmann | |
| 7,409,736 | B2 | | 8/2008 | Konen | |
| 7,441,337 | B2 | | 10/2008 | Linden | |
| 7,497,016 | B1 | | 3/2009 | Wu | |
| 7,536,791 | B2 | * | 5/2009 | Toyama | 30/254 |
| 7,549,226 | B2 | | 6/2009 | Mortensen | |
| D618,078 | S | | 6/2010 | Cripps et al. | |
| 8,327,548 | B2 | * | 12/2012 | Ronan | 30/175 |
| 2002/0138990 | A1 | | 10/2002 | Gluck et al. | |
| 2004/0000058 | A1 | * | 1/2004 | Shyr | 30/262 |
| 2004/0163495 | A1 | | 8/2004 | Konen | |
| 2006/0137192 | A1 | * | 6/2006 | Deter | 30/248 |
| 2006/0248730 | A1 | * | 11/2006 | Miller et al. | 30/175 |
| 2007/0199198 | A1 | | 8/2007 | Hsieh | |
| 2008/0022533 | A1 | * | 1/2008 | Zeller et al. | 30/134 |
| 2008/0022535 | A1 | | 1/2008 | Underhill | |
| 2008/0110030 | A1 | | 5/2008 | Seber et al. | |
| 2008/0184566 | A1 | * | 8/2008 | Deter | 30/252 |
| 2008/0184567 | A1 | * | 8/2008 | Jou | 30/262 |
| 2009/0277019 | A1 | * | 11/2009 | Mueller | 30/262 |
| 2010/0212162 | A1 | * | 8/2010 | Ronan | 30/122 |
| 2011/0131814 | A1 | * | 6/2011 | Musser | 30/260 |
| 2011/0154669 | A1 | * | 6/2011 | Liu et al. | 30/260 |
| 2012/0023756 | A1 | * | 2/2012 | Schneider et al. | 30/254 |
| 2012/0047750 | A1 | * | 3/2012 | Maag et al. | 30/251 |

* cited by examiner

HAND CUTTING TOOL

CROSS-REFERENCE TO RELATED APPLICATIONS

This application claims priority to U.S. Provisional Patent Application No. 61/368,146, filed Jul. 27, 2010, the entire contents of which are hereby incorporated by reference herein.

BACKGROUND

The present invention relates to a hand tool, such as a hand cutting tool including tin snips or aviation snips.

Hand cutting tools often include two cutting blades that pivot with respect to each other to cut a work-piece. The cutting blades pivot with respect to each other to cut the work-piece by manually pivoting two handles of the cutting tool with respect to each other. In some hand cutting tools, such as tools where the handles and cutting blades are spring biased toward an open position, it is desirable to lock the handles in a closed position so that the blades do not open or spread apart when the cutting tool is not in use. Therefore, these types of hand cutting tools often include a handle lock that allows the user to lock the handles and cutting blades in the closed position.

SUMMARY

In one embodiment the invention provides a hand cutting tool that includes a first cutting blade, a second cutting blade pivotally coupled to the first cutting blade such that the second cutting blade pivots with respect to the first cutting blade about a pivot axis, a first handle, and a second handle that is pivotally coupled to the first handle such that the second handle pivots with respect to the first handle from an open position to a closed position to pivot the second cutting blade toward the first cutting blade to cut a work-piece and the second handle pivots with respect to the first handle from the closed position to the open position to pivot the second cutting blade away from the first cutting blade. The hand cutting tool further includes a handle lock assembly configured to retain the second handle in the closed position. The handle lock assembly includes a latch pivotally coupled to the first handle such that the latch pivots with respect to the first handle about a latch axis from a locked position to an unlocked position and the latch pivots with the first handle with respect to the second handle, and a pin movably coupled to the second handle such the pin is manually movable with respect to the second handle between an engaged position and a released position and the pin pivots with the second handle with respect to the first handle. In a latched position of the handle lock assembly, the latch is in the locked position and engages the pin in the engaged position to retain the second handle in the closed position, and in an unlatched position of the handle lock assembly, the latch is in the unlocked position and is disengaged from the pin in response to the pin being manually moved to the released position to allow the second handle to move toward the open position.

In another embodiment the invention provides a hand cutting tool including a first cutting blade, a second cutting blade pivotally coupled to the first cutting blade such that the second cutting blade pivots with respect to the first cutting blade about a pivot axis, a first handle, and a second handle that is pivotally coupled to the first handle such that the second handle pivots with respect to the first handle from an open position to a closed position to pivot the second cutting blade toward the first cutting blade to cut a work-piece and the second handle pivots with respect to the first handle from the closed position to the open position to pivot the second cutting blade away from the first cutting blade. The hand cutting tool further includes a handle lock assembly configured to retain the second handle in the closed position. The handle lock assembly includes a first latch member pivotally coupled to the first handle such that the first latch member pivots with respect to the first handle about a latch axis from a locked position to an unlocked position and the first latch member pivots with the first handle with respect to the second handle, and a second latch member slidably coupled to the second handle such the second latch member is manually slidable with respect to the second handle along a latch member axis between an engaged position and a released position and the second latch member pivots with the second handle with respect to the first handle. In a latched position of the handle lock assembly, the first latch member is in the locked position and engages the second latch member in the engaged position to retain the second handle in the closed position, and in an unlatched position of the handle lock assembly, the first latch member is in the unlocked position and is disengaged from the second latch member in response to the second latch member being manually slid along the latch member axis to the released position to allow the second handle to move toward the open position.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
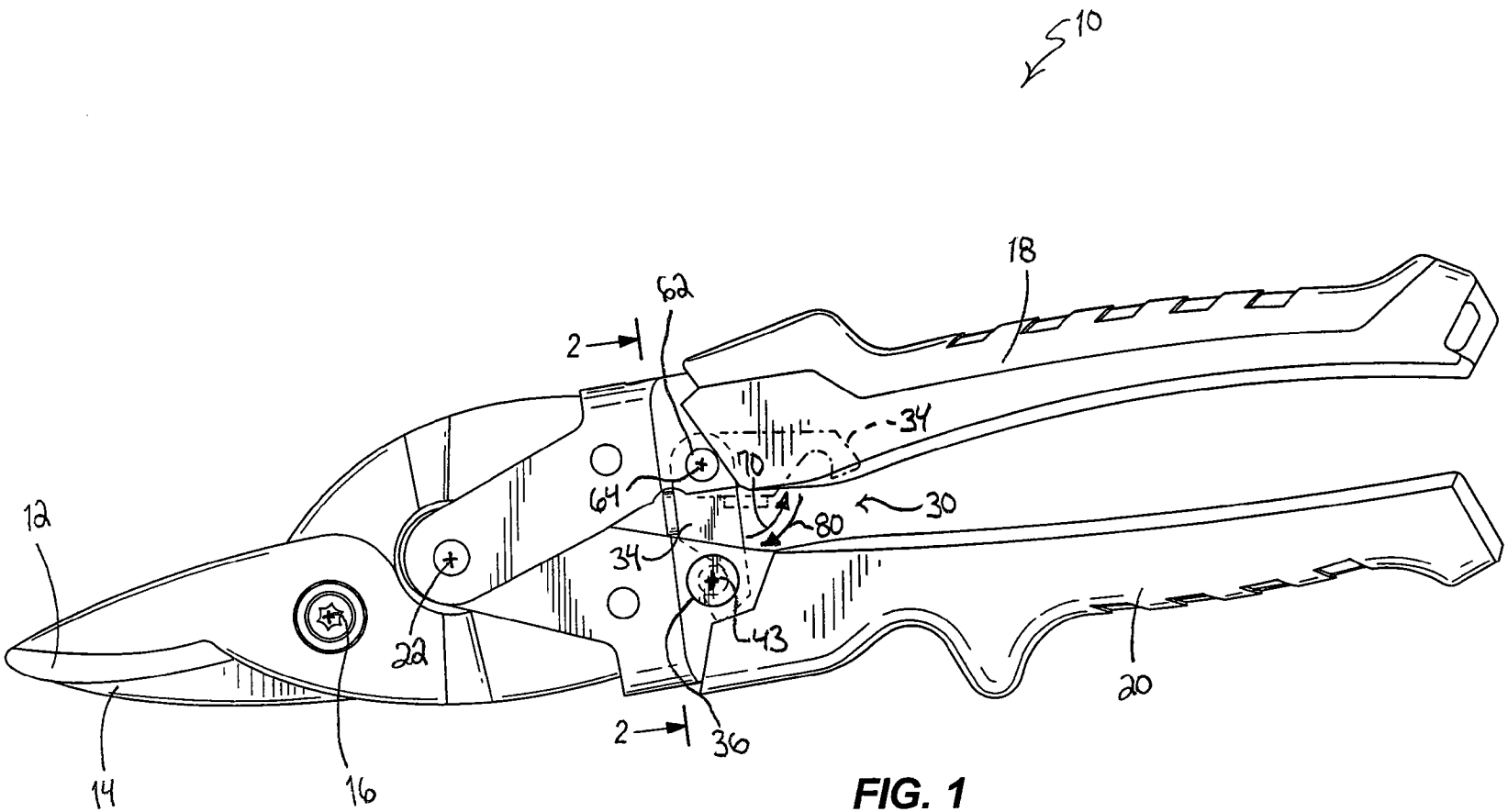
FIG. 1 is a side view of a hand cutting tool according to an embodiment of the invention.

FIG. 1 illustrates a hand cutting tool 10. In the illustrated embodiment, the hand cutting tool 10 is a tin snips or aviation snips. In other embodiments, the hand cutting tool can include other types of hand cutting tools, such as wire cutters, shears, etc. The snips 10 includes a first or upper blade 12 and a second or lower blade 14. The upper blade 12 and the lower blade 14 pivot with respect to each other about a pivot axis 16. A first or upper handle 18 is coupled to the lower blade 14 and a second or lower handle 20 is coupled to the upper blade 12. The handles 18, 20 pivot with respect to each other about a pivot axis 22 to pivot the blades 12 and 14 relative to each other about the pivot axis 16 to operate the snips 10.

Figure 2:
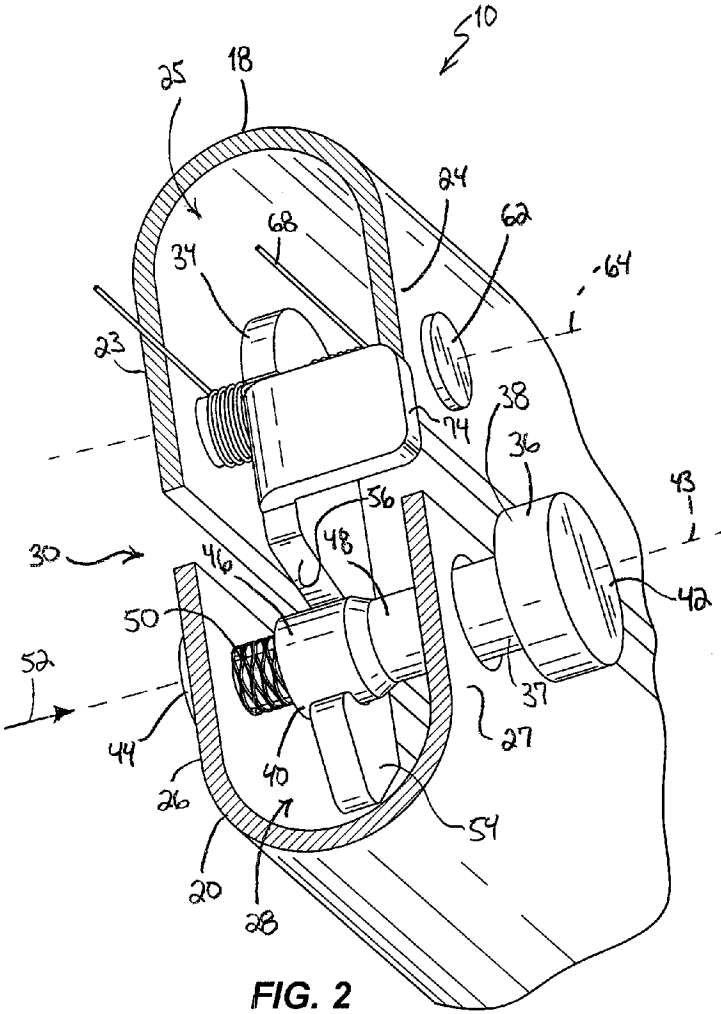
FIG. 2 is a partial cross-sectional view of the hand cutting tool taken along line 2-2 of FIG. 1 and illustrates a handle lock assembly of the hand cutting tool in a latched position.

Referring to FIG. 2, the upper handle 18 includes a first side wall 23, a second side wall 24, and an interior space 25 between the side wall 23 and the side wall 24. Similarly, the lower handle 20 includes a first side wall 26, a second side wall 27, and an interior space 28 between the side wall 26 and the side wall 27.

Referring to FIGS. 1 and 2, the snips 10 further includes a handle lock assembly 30 that retains the handles 18, 20 in a closed position, which is illustrated in FIG. 1. In the illustrated embodiment, the handles 18, 20 are spring biased toward an open position and the handle lock assembly 30 inhibits the handles 18, 20 from moving toward the open position where the blades 12, 14 would also be opened.

Referring to FIG. 2, the handle lock assembly 30 includes a first latch member 34 and a second latch member 36 onto which the first latch member 34 hooks or latches to retain the handles 18, 20 in the closed position. In the illustrated embodiment, the second latch member 36 includes a pin 37 having a first end portion 38 and a second end portion 40. The first end portion 38 includes a release button 42 that is accessible by a user to manually move the pin 37 along an axis 43 with respect to an inner pin 44 of the second latch member 36 that is fixed with respect to a portion of the handle 20. In the illustrated embodiment, the pin 37 slides with respect to the handle 20 along the inner pin 44 and along the axis 43 that is parallel to the pivot axis 16 (FIG. 1).

The second end portion 40 of the pin 37 includes a section 46 having a diameter larger than a section 48 of the first end portion 38 of the pin 37. A biasing member 50, which is a coil spring in one embodiment, is disposed between the handle 20 and the pin 37 and surrounds the inner pin 44 to bias the pin 37 in the direction of arrow 52 (FIG. 2). Although in the illustrated embodiment, the pin 37 is illustrated as generally cylindrical and round, in other embodiments, the pin can have other suitable shapes (e.g., non-round). In the illustrated embodiment, the inner pin 44 is formed by a rivet that extends through the side wall 26 of the handle 20 and into the pin 37.

Figure 4:
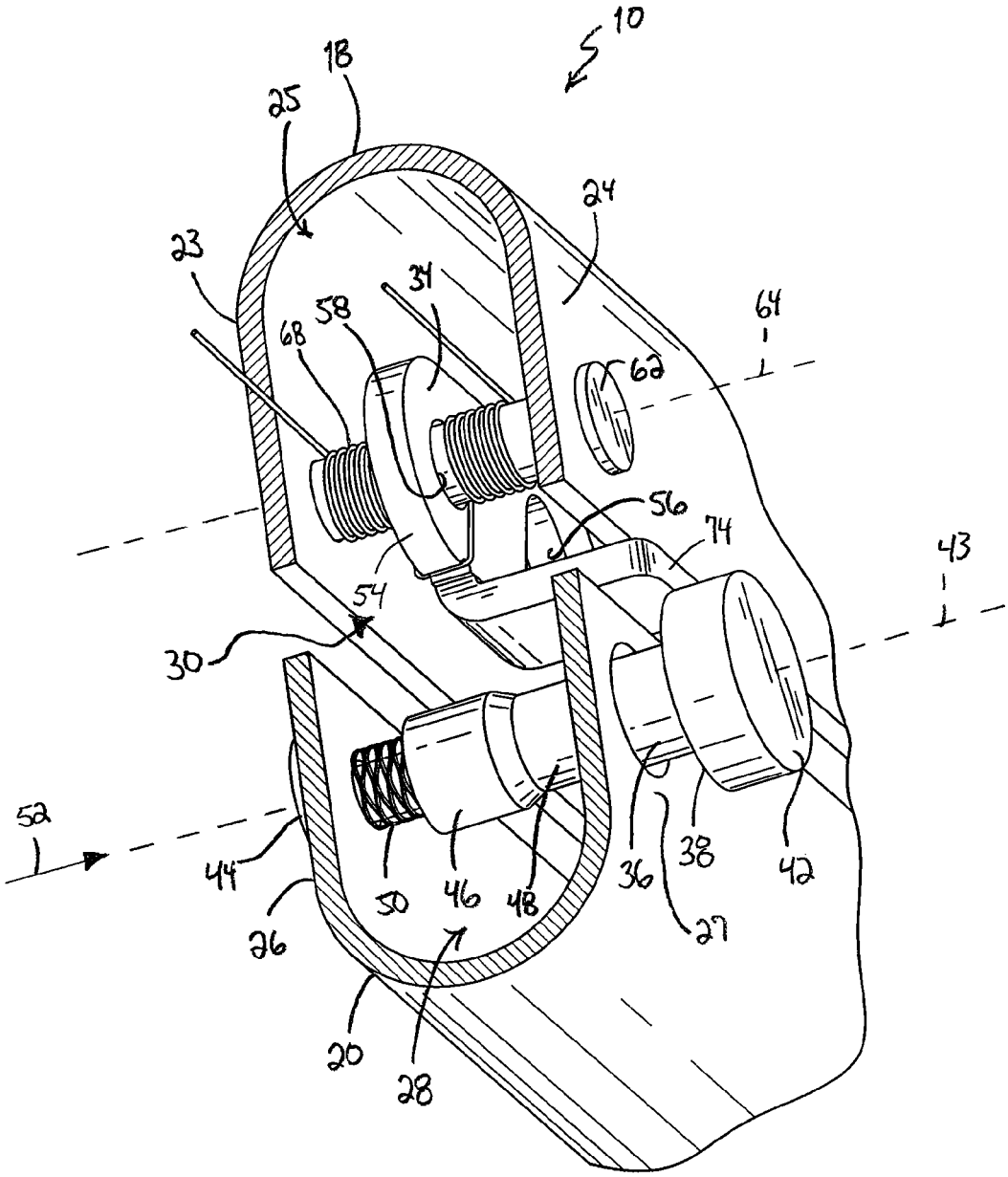
FIG. 4 is a partial cross-sectional view of the hand cutting tool taken along line 2-2 of FIG. 1 illustrating the handle lock assembly in the unlatched position.

With continued reference to FIGS. 2 and 4, the first latch member 34 includes a latch 54 including a hook 56 and an aperture 58. A pin 62, which is formed by a rivet in the illustrated embodiment, extends through the side walls 23, 24 of the handle 18 and the aperture 58. The pin 62 couples the latch 54 to the handle 18 for rotation with respect to the handle 18 about an axis 64. A biasing member 68, which is a torsion spring in the illustrated embodiment, is disposed around the pin 62 and biases the latch 54 about the axis 64 in the direction of arrow 70 of FIG. 1. The latch 54 further includes an actuator 74, which is formed by a tab that is integrally formed with latch 54 as a single component in the illustrated embodiment. The actuator 74 provides a place for the user to move the latch 54, typically with one of the user's fingers.

Figure 3:
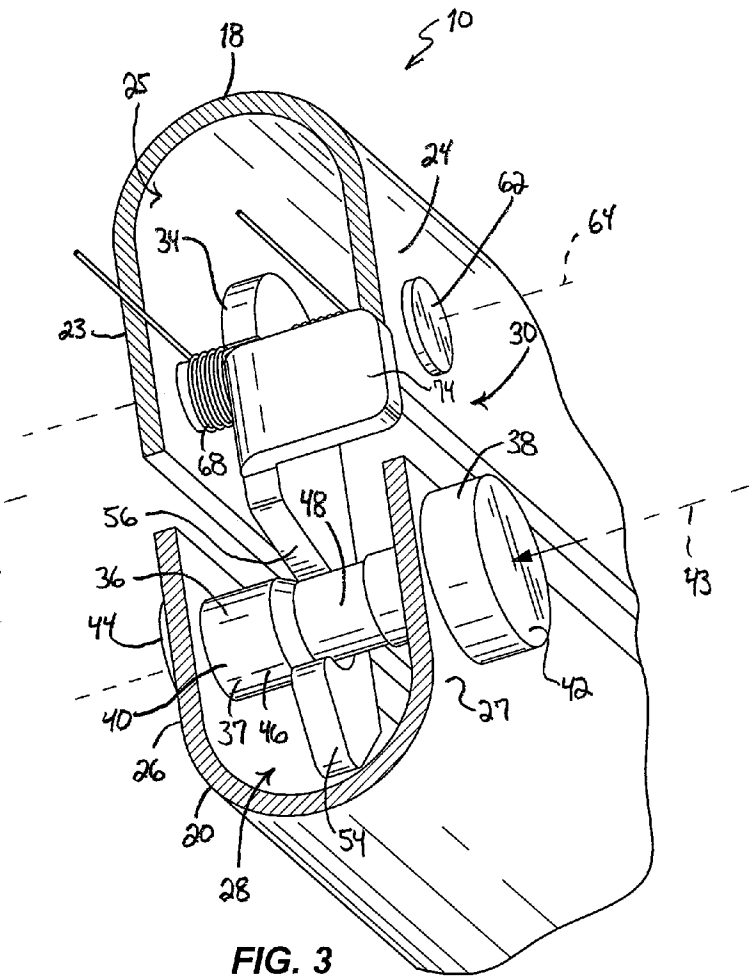
FIG. 3 is a partial cross-sectional view of the hand cutting tool taken along line 2-2 of FIG. 1 illustrating the handle lock assembly between the latched position and an unlatched position.

In operation, referring to FIG. 1, the user grabs or grips the upper handle 18 and the lower handle 20 and pivots the handles 18, 20 with respect to each other about pivot axis 22 in order to pivot the blades 12, 14 about the pivot axis 16 to cut a work-piece. After using the snips 10, the user may desire to lock the handles 18, 20, which are spring biased to the open position, in the closed position (FIG. 1) so that the handles 18, 20 do not open when the snips 10 is in the user's tool belt or the like. To lock the handles 18, 20 the user moves the lock assembly 30 to a latched position (FIG. 2). To move the lock assembly 30 from an unlatched position (FIG. 4) to the latched position (FIG. 2), the user uses the tab 74 to pivot the hook 56 of the latch 54 about the axis 64 in the direction of arrow 80 (FIG. 1) against the bias of the torsion spring 68. Meanwhile, the user presses release button 42 to move the pin 37 to a released position, as illustrated in FIG. 3. In the released position of the pin 37, the large diameter section 46 of the pin 37 is moved out of the way of the hook 56 and the small diameter section 48 is positioned so that the hook 56 can move over and partially surround the pin 37 (FIG. 3). Then, the user releases the button 42 and the spring 50 moves the pin 37 to an engaged position (FIG. 2) so that the large diameter section 46 of the pin 37 is within the hook 56. With the large diameter section 46 of the pin 37 within the hook 56 as illustrated in FIG. 2, the pin 37 retains the hook 56 in the position illustrated in FIG. 2 and retains the lock assembly 30 in the latch position to inhibit the handles 18, 20 from moving to the open position.

In a further embodiment, the pin 37 includes a cam surface (not illustrated) or the like on or adjacent the large diameter section 46 of the pin 37. The cam surface automatically moves the pin 37 to the released position when the user pivots the hook 56 toward the latched position. Therefore, the user does not need to press the button 42 to move the pin 37 to the released position when the user wants to place the lock assembly 30 in the latched position.

Referring to FIGS. 2-4, to unlock the handles 18, 20 and the handle lock assembly 30, the user presses the release button 42 to move the pin 37 from the engaged position (FIG. 2) to the disengaged position (FIG. 3). With the pin 37 in the disengaged position, the large diameter portion 46 of the pin 37 is positioned out of the hook 56 and the small diameter portion 48 of the pin 37 is positioned within the hook 56. In the disengaged position, the pin 37 no longer holds the hook 56 of the latch 54 in the locked position and the latch 54 moves to the unlocked position (FIG. 4) due to the bias of the torsion spring 68.

Although the invention has been described in detail with reference to certain preferred embodiments, variations and modifications exist within the scope and spirit of one or more independent aspects of the invention as described.

What is claimed is:

1. A hand cutting tool comprising:

a first cutting blade;

a second cutting blade pivotally coupled to the first cutting blade such that the second cutting blade pivots with respect to the first cutting blade about a pivot axis;

a first handle;

a second handle pivotally coupled to the first handle such that the second handle pivots with respect to the first handle from an open position to a closed position to pivot the second cutting blade toward the first cutting blade to cut a work-piece and the second handle pivots with respect to the first handle from the closed position to the open position to pivot the second cutting blade away from the first cutting blade;

a handle lock assembly configured to retain the second handle in the closed position, the handle lock assembly including, a latch pivotally coupled to the first handle such that the latch pivots with respect to the first handle about a latch axis from a locked position to an unlocked position and the latch pivots with the first handle with respect to the second handle, and a pin movably coupled to the second handle such the pin is manually movable with respect to the second handle between an engaged position and a released position and the pin pivots with the second handle with respect to the first handle, wherein in a latched position of the handle lock assembly, the latch is in the locked position and engages the pin in the engaged position to retain the second handle in the closed position, and wherein in an unlatched position of the handle lock assembly, the latch is in the unlocked position and is disengaged from the pin in response to the pin being manually moved to the released position to allow the second handle to move toward the open position.

2. The hand cutting tool of claim 1, wherein the latch includes a hook.

3. The hand cutting tool of claim 2, wherein the handle lock assembly further includes a button coupled to the pin to move the pin from the engaged position to the released position along a pin axis.

4. The hand cutting tool of claim 3, wherein the pin axis is parallel to the pivot axis.

5. The hand cutting tool of claim 2, wherein the pin includes a first portion having a first diameter and a second portion having a second diameter larger than the first diameter, wherein the second portion of the pin is received within the hook when the handle lock assembly is in the latched position to retain the latch in the locked position, and wherein when the first portion of the pin is positioned within the hook, the latch moves toward the unlocked position.

6. The hand cutting tool of claim 1, wherein the pin is slidably coupled to the second handle such that the pin slides with respect to the second handle along a pin axis.

7. The hand cutting tool of claim 6, wherein the pin axis is parallel to the pivot axis.

8. The hand cutting tool of claim 1, further comprising a first biasing member that biases the latch toward the unlocked position and a second biasing member that biases the pin toward the engaged position.

9. The hand cutting tool of claim 8, wherein the first biasing member causes the latch to automatically move to the unlocked position and disengage the pin when the pin is manually moved from the engaged position to the released position.

10. The hand cutting tool of claim 1, wherein the second handle includes a first side wall, a second side wall, and an interior space between the first side wall and the second side wall, and wherein the latch engages the pin within the interior space of the second handle.

11. The hand cutting tool of claim 10, wherein the first handle includes a first side wall, a second side wall, and an interior space between the first side wall and the second side wall, and wherein the latch is pivotally coupled to the first handle within the interior space between the first and second side walls of the first handle.

12. A hand cutting tool comprising:

a first cutting blade;

a second cutting blade pivotally coupled to the first cutting blade such that the second cutting blade pivots with respect to the first cutting blade about a pivot axis;

a first handle;

a second handle pivotally coupled to the first handle such that the second handle pivots with respect to the first handle from an open position to a closed position to pivot the second cutting blade toward the first cutting blade to cut a work-piece and the second handle pivots with respect to the first handle from the closed position to the open position to pivot the second cutting blade away from the first cutting blade;

a handle lock assembly configured to retain the second handle in the closed position, the handle lock assembly including, a first latch member pivotally coupled to the first handle such that the first latch member pivots with respect to the first handle about a latch axis from a locked position to an unlocked position and the first latch member pivots with the first handle with respect to the second handle, and a second latch member slidably coupled to the second handle such the second latch member is manually slidable with respect to the second handle along a latch member axis between an engaged position and a released position and the second latch member pivots with the second handle with respect to the first handle, wherein in a latched position of the handle lock assembly, the first latch member is in the locked position and engages the second latch member in the engaged position to retain the second handle in the closed position, and wherein in an unlatched position of the handle lock assembly, the first latch member is in the unlocked position and is disengaged from the second latch member in response to the second latch member being manually slid along the latch member axis to the released position to allow the second handle to move toward the open position.

13. The hand cutting tool of claim 12, wherein the latch member axis is parallel to the pivot axis.

14. The hand cutting tool of claim 12, wherein the first latch member includes a hook, and wherein the second latch member includes a pin that is received by the hook when the handle lock assembly is in the latched position.

15. The hand cutting tool of claim 14, wherein the handle lock assembly further includes a button coupled to the pin to move the pin from the engaged position to the released position along the latch member axis.

16. The hand cutting tool of claim 14, wherein the pin includes a first portion having a first diameter and a second portion having a second diameter larger than the first diameter, wherein the second portion of the pin is received within the hook when the handle lock assembly is in the latched position to retain the hook in the locked position, and wherein when the first portion of the pin is positioned within the hook, the hook moves toward the unlocked position.

17. The hand cutting tool of claim 12, further comprising a first biasing member that biases the first latch member toward the unlocked position and a second biasing member that biases the second latch member toward the engaged position.

18. The hand cutting tool of claim 17, wherein the first biasing member causes the first latch member to automatically move to the unlocked position and disengage the second latch member when the second latch member is manually moved from the engaged position to the released position.

19. The hand cutting tool of claim 12, wherein the second handle includes a first side wall, a second side wall, and an interior space between the first side wall and the second side wall, and wherein the first latch member engages the second latch member within the interior space of the second handle.

20. The hand cutting tool of claim 19, wherein the first handle includes a first side wall, a second side wall, and an interior space between the first side wall and the second side wall, and wherein the first latch member is pivotally coupled to the first handle within the interior space between the first and second side walls of the first handle.

* * * * *